US011600217B2

(12) United States Patent
Pyo et al.

(10) Patent No.: US 11,600,217 B2
(45) Date of Patent: Mar. 7, 2023

(54) OPTICAL COMPENSATION SYSTEM AND OPTICAL COMPENSATION METHOD OF DISPLAY DEVICE

(71) Applicant: Samsung Display Co., Ltd., Yongin-Si (KR)

(72) Inventors: Si Beak Pyo, Yongin-si (KR); Hyun Jung Son, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/734,408

(22) Filed: May 2, 2022

(65) Prior Publication Data

US 2022/0262299 A1 Aug. 18, 2022

Related U.S. Application Data

(63) Continuation of application No. 17/008,047, filed on Aug. 31, 2020, now Pat. No. 11,322,075.

(30) Foreign Application Priority Data

Dec. 27, 2019 (KR) ..... 10-2019-0176602

(51) Int. Cl.
*G09G 3/22* (2006.01)
*G09G 5/10* (2006.01)

(52) U.S. Cl.
CPC ..... *G09G 3/22* (2013.01); *G09G 5/10* (2013.01); *G09G 2300/0809* (2013.01); *G09G 2310/0267* (2013.01); *G09G 2310/0275* (2013.01); *G09G 2310/0286* (2013.01); *G09G 2310/08* (2013.01); *G09G 2320/041* (2013.01);
(Continued)

(58) Field of Classification Search
CPC ..... G09G 3/22
See application file for complete search history.

(56) References Cited

U.S. PATENT DOCUMENTS 8,896,636 B2 11/2014 Lee et al.
8,982,164 B2 3/2015 Pyo
(Continued)

FOREIGN PATENT DOCUMENTS

CN 103198779 A 7/2013
KR 10-1065320 B1 9/2011
(Continued)

*Primary Examiner* — Gustavo Polo
(74) *Attorney, Agent, or Firm* — Innovation Counsel LLP

(57) ABSTRACT

Provided is an optical compensation method for a display device including a pixel coupled between first power and second power sources. In the optical compensation method, the first voltage level of the second power source corresponding to a first luminance level is set while measuring the luminance of the display device, the second voltage level of the second power source corresponding to a second luminance level is set while measuring the luminance of the display device, the third voltage levels of the second power source for representative luminance levels including the first and second luminance levels are set based on the first and second voltage levels, and the fourth voltage levels of the second power source for the representative luminance levels according to temperature conditions are set based on the third voltage levels and temperature offsets according to the temperature conditions, under which the display device is driven.

20 Claims, 10 Drawing Sheets

(52) U.S. Cl.
CPC ..... *G09G 2320/0673* (2013.01); *G09G 2330/021* (2013.01); *G09G 2360/145* (2013.01)

(56) References Cited

U.S. PATENT DOCUMENTS

| | | | | |
|---|---|---|---|---|
| 9,013,519 | B2 | 4/2015 | Park et al. | |
| 9,099,033 | B2 | 8/2015 | Son et al. | |
| 9,478,166 | B2 | 10/2016 | Pyo et al. | |
| 9,953,573 | B2 | 4/2018 | Pyo et al. | |
| 10,522,075 | B2 | 12/2019 | Pyo et al. | |
| 2013/0176349 | A1 | 7/2013 | Park et al. | |
| 2015/0130690 | A1* | 5/2015 | Kim | G09G 3/3233 315/307 |
| 2015/0138251 | A1 | 5/2015 | Pyo | |
| 2017/0294156 | A1 | 10/2017 | Pyo et al. | |
| 2019/0130827 | A1 | 5/2019 | Pyo et al. | |
| 2019/0304372 | A1 | 10/2019 | Pyo et al. | |
| 2019/0311682 | A1 | 10/2019 | Pyo et al. | |
| 2019/0340981 | A1 | 11/2019 | Pyo | |

FOREIGN PATENT DOCUMENTS

| | | | |
|---|---|---|---|
| KR | 10-1094303 | B1 | 12/2011 |
| KR | 10-2015-0056940 | A | 5/2015 |
| KR | 10-2019-0049977 | A | 5/2019 |
| KR | 10-2019-0114062 | A | 10/2019 |
| KR | 10-2019-0116607 | A | 10/2019 |

* cited by examiner

FIG. 7A

LUT1

| # of DBV Band | Luminance | Base DBV Offset LUT_Input | | | |
|---|---|---|---|---|---|
| | | DBV LUT Offset | | | |
| | [nits] | 25°C | 0°C | −10°C | −20°C |
| 0 | 750 | 0.0 | 0.0 | 0.0 | 0.0 |
| 1 | 650 | 0.2 | −0.4 | −0.6 | −0.6 |
| 2 | 300 | 1.0 | 0.6 | 0.0 | −0.5 |
| 3 | 100 | 1.0 | 0.6 | 0.3 | −0.2 |
| 4 | 60 | 1.0 | 0.6 | 0.3 | 0.0 |
| 5 | 30 | 1.0 | 0.6 | 0.3 | 0.1 |
| 6 | 15 | 0.9 | 0.5 | 0.2 | 0.2 |
| 7 | 10 | 0.8 | 0.4 | 0.3 | 0.3 |
| 8 | 7 | 0.7 | 0.4 | 0.4 | 0.4 |
| 9 | 4 | 0.6 | 0.4 | 0.4 | 0.4 |
| 10 | 2 | 0.5 | 0.4 | 0.4 | 0.4 |

FIG. 7B

LUT2

| # of DBV Band | Luminance | Base DBV LUT_Generation | | | |
|---|---|---|---|---|---|
| | | DBV LUT (FOR EACH LUMINANCE/TEMPERATURE) Based On 1st ELVSS Searching | | | |
| | [nits] | 25°C | 0°C | −10°C | −20°C |
| 0 | 750 | −3.6 | −3.6 | −3.6 | −3.6 |
| 1 | 650 | −3.4 | −4.0 | −4.2 | −4.2 |
| 2 | 300 | −2.6 | −3.0 | −3.6 | −4.1 |
| 3 | 100 | −2.6 | −3.0 | −3.3 | −3.8 |
| 4 | 60 | −2.6 | −3.0 | −3.3 | −3.6 |
| 5 | 30 | −2.6 | −3.0 | −3.3 | −3.5 |
| 6 | 15 | −2.7 | −3.1 | −3.4 | −3.4 |
| 7 | 10 | −2.8 | −3.2 | −3.3 | −3.3 |
| 8 | 7 | −2.9 | −3.2 | −3.2 | −3.2 |
| 9 | 4 | −3.0 | −3.2 | −3.2 | −3.2 |
| 10 | 2 | −3.1 | −3.2 | −3.2 | −3.2 |

FIG. 7C

LUT3

| # of DBV Band | Luminance | MPS OFFSET EXTRACTION FOR EACH LUMINANCE/TEMPERATURE | | | |
|---|---|---|---|---|---|
| | | OFFSET FOR EACH LUMINANCE | OFFSET – FIXED FOR EACH TEMPERATURE | | |
| | [nits] | 25°C | 0°C | −10°C | −20°C |
| 0 | 750 | – | 0.0 | 0.0 | 0.0 |
| 1 | 650 | – | −0.6 | −0.8 | −0.8 |
| 2 | 300 | – | −0.4 | −1.0 | −1.5 |
| 3 | 100 | 0.0 | −0.4 | −0.7 | −1.2 |
| 4 | 60 | 0.0 | −0.4 | −0.7 | −1.0 |
| 5 | 30 | 0.0 | −0.4 | −0.7 | −0.9 |
| 6 | 15 | −0.1 | −0.4 | −0.7 | −0.7 |
| 7 | 10 | −0.2 | −0.4 | −0.5 | −0.5 |
| 8 | 7 | −0.3 | −0.3 | −0.3 | −0.3 |
| 9 | 4 | −0.4 | −0.2 | −0.2 | −0.2 |
| 10 | 2 | −0.5 | −0.1 | −0.1 | −0.1 |

FIG. 7D

LUT4

| # of DBV Band | Luminance | Converted DBV LUT (ELVSS) Based On 2nd ELVSS Searching & Extracted Offset | | | |
|---|---|---|---|---|---|
| | [nits] | 25°C | 0°C | −10°C | −20°C |
| 0 | 750 | −3.6 | −3.6 | −3.6 | −3.6 |
| 1 | 650 | −3.4 | −4.0 | −4.2 | −4.2 |
| 2 | 300 | −2.5 | −2.9 | −3.5 | −4.0 |
| 3 | 100 | −2.0 | −2.4 | −2.7 | −3.2 |
| 4 | 60 | −2.0 | −2.4 | −2.7 | −3.0 |
| 5 | 30 | −2.0 | −2.4 | −2.7 | −2.9 |
| 6 | 15 | −2.1 | −2.5 | −2.8 | −2.8 |
| 7 | 10 | −2.2 | −2.6 | −2.7 | −2.7 |
| 8 | 7 | −2.3 | −2.6 | −2.6 | −2.6 |
| 9 | 4 | −2.4 | −2.6 | −2.6 | −2.6 |
| 10 | 2 | −2.5 | −2.6 | −2.6 | −2.6 |

OPTICAL COMPENSATION SYSTEM AND OPTICAL COMPENSATION METHOD OF DISPLAY DEVICE

CROSS-REFERENCE TO RELATED APPLICATION

The present application is a continuation application of U.S. patent application Ser. No. 17/008,047 filed on Aug. 31, 2020, which claims priority to Korean Patent Application No. 10-2019-0176602 filed on Dec. 27, 2019, in Korean Intellectual Property Office, and all the benefits accruing therefrom under 35 U.S.C. 119, the contents of which in its entirety are herein incorporated by reference.

BACKGROUND

1. Technical Field

Generally, the present disclosure relates to a display device. Particularly, the present disclosure relates to an optical compensation system configured to compensate for the optical characteristics of a display device and an optical compensation method of the display device.

2. Related Art

A display device includes pixels, and each of the pixels may include a light-emitting element and a transistor configured to drive the light-emitting element. Generally, a typical manufacturing process to fabricate such a display device including a low-temperature polysilicon process, a deposition process, and the like may cause variation in the luminance of the pixels.

Therefore, the process of measuring the luminance of a display device (or an image displayed through the display device) and the process of adjusting a voltage applied to the display device (or the process of adjusting an offset for the emission characteristic of each of the pixels) are repeated several times during the process of manufacturing the display device, whereby the luminance variation may be compensated for. This process of compensating for the luminance variation is referred to as optical compensation.

Meanwhile, recently, in order to reduce the amount of power consumed by a display device, the display device may be driven while changing a power source voltage depending on driving conditions (e.g., luminance, temperature, and the like).

Thus, a novel way to develop an optical compensation system to improve display quality of a display device and the method of the same, which reduces power consumption, is needed.

SUMMARY

The voltage levels of a varying power source voltage are set using preset offsets (that is, offset values applied in common to display devices of the same type). However, because the display devices have process variation, the offsets include a sufficient margin, which may relatively lower the power-saving efficiency of each of the display devices.

Various embodiments of the present disclosure are directed to an optical compensation system and an optical compensation method of a display device, which are capable of more improving the power-saving efficiency of the display device.

An embodiment of the present disclosure may provide for an optical compensation system. The optical compensation system may include a display device including a pixel coupled between a first power source and a second power source; a compensator configured to sequentially supply the display device with the second power source having a first voltage level corresponding to a first luminance level and the second power source having a second voltage level corresponding to a second luminance level; and an imaging device configured to measure the luminance values of the display device corresponding to the first luminance level and the second luminance level. Here, the compensator may adjust each of the first voltage level and the second voltage level based on the luminance values measured by the imaging device, set the third voltage levels of the second power source for representative luminance levels, including the first luminance level and the second luminance level, based on the first voltage level and the second voltage level, and set the fourth voltage levels of the second power source for the representative luminance levels according to temperature conditions, under which the display device is driven, based on temperature offsets according to the temperature conditions and on the third voltage levels.

According to an embodiment, the pixel may include a light-emitting element, a driving transistor configured to supply a current to the light-emitting element, and an emission transistor coupled between the light-emitting element and the driving transistor and configured to adjust the emission time of the light-emitting element, the first luminance level may correspond to the maximum luminance of the display device, the current may vary in a luminance range between the first luminance level and the second luminance level, and the current is fixed, but the emission time may vary at luminance levels lower than the second luminance level.

According to an embodiment, the second power source may have a voltage level lower than the voltage level of the first power.

According to an embodiment, the compensator may include a luminance level selector configured to select the first luminance level and the second luminance level from among a plurality of luminance levels; a power output component configured to adjust and output the first voltage level and the second voltage level of the second power source; an interpolator configured to set the third voltage levels based on the first voltage level and the second voltage level; and a lookup table converter configured to set the fourth voltage levels based on the third voltage levels and the temperature offsets.

According to an embodiment, the interpolator may set voltage levels for luminance levels between the first luminance level and the second luminance level by interpolating the first voltage level and the second voltage level.

According to an embodiment, the lookup table converter may set voltage levels at the luminance levels lower than the second luminance level based on a luminance offset which is preset based on the second voltage level.

According to an embodiment, the compensator may further include a reference lookup table generator configured to set reference voltage levels for the second power source according to driving conditions based on the first voltage level and reference offsets according to the driving conditions, which are preset based on the first luminance level; and an offset extractor configured to calculate the luminance offset for the voltage levels for the luminance levels lower than the second luminance level.

According to an embodiment, the offset extractor may extract the temperature offsets from the reference offsets, and the lookup table converter may calculate each of the fourth voltage levels by adding each of the third voltage levels and a corresponding temperature offset among the temperature offsets.

According to an embodiment, the offset extractor may calculate the temperature offsets by calculating the difference between a first reference voltage level under a first temperature condition and a second reference voltage level under a second temperature condition among the reference voltage levels, and the first reference voltage level and the second reference voltage level may correspond to the same luminance level.

According to an embodiment, the first luminance level may correspond to the maximum luminance of the display device, and the second luminance level may correspond to luminance having the lowest voltage level or a voltage level of the smallest voltage magnitude, among reference voltage levels derived for driving conditions based on the first voltage level.

According to an embodiment, the compensator may set voltage levels for at least some of luminance levels lower than the second luminance level by extrapolating the first voltage level and the second voltage level.

An embodiment of the present disclosure may provide for an optical compensation method of a display device. The optical compensation method may include steps of setting the first voltage level of second power source corresponding to a first luminance level while measuring the luminance of the display device including a pixel coupled between the sources of first power and the second power source; setting the second voltage level of the second power source corresponding to a second luminance level while measuring the luminance of the display device; setting the third voltage levels of the second power source for representative luminance levels, including the first luminance level and the second luminance level, based on the first voltage level and the second voltage level; and setting the fourth voltage levels of the second power source for the representative luminance levels according to temperature conditions, under which the display device is driven, based on temperature offsets according to the temperature conditions and on the third voltage levels.

According to an embodiment, the pixel may include a light-emitting element, a driving transistor configured to supply a current to the light-emitting element, and an emission transistor coupled between the light-emitting element and the driving transistor and configured to adjust the emission time of the light-emitting element, the first luminance level may correspond to the maximum luminance of the display device, the current may vary in a luminance range between the first luminance level and the second luminance level, and the current is fixed, but the emission time may vary at luminance levels lower than the second luminance level.

According to an embodiment, the second power source may have a voltage level lower than the voltage level of the first power.

According to an embodiment, the step of setting the third voltage levels may include a step of setting voltage levels for luminance levels between the first luminance level and the second luminance level by interpolating the first voltage level and the second voltage level.

According to an embodiment, the step of setting the third voltage levels may further include a step of setting voltage levels at the luminance levels lower than the second luminance level based on a luminance offset which is preset based on the second voltage level.

According to an embodiment, the step of setting the fourth voltage levels may include steps of extracting the temperature offsets from reference offsets for respective driving conditions which are preset based on the first luminance level; and adding each of the third voltage levels and a corresponding temperature offset among the temperature offsets.

According to an embodiment, the step of extracting the temperature offsets may include steps of setting reference voltage levels for the second power source for the respective driving conditions based on the first voltage level and the reference offsets according to the driving conditions which are preset based on the first luminance level; and calculating the difference between a first reference voltage level under a first temperature condition and a second reference voltage level under a second temperature condition among the reference voltage levels. The first reference voltage level and the second reference voltage level may correspond to the same luminance level.

According to an embodiment, the first luminance level may correspond to the maximum luminance of the display device, and the second luminance level may correspond to luminance having the lowest voltage level or a voltage level of the smallest voltage magnitude among reference voltage levels derived for driving conditions based on the first voltage level.

According to an embodiment, the step of setting the third voltage levels may include a step of setting voltage levels for at least some of luminance levels lower than the second luminance level by extrapolating the first voltage level and the second voltage level.

BRIEF DESCRIPTION OF THE DRAWINGS

The above and other features of the disclosure will become more apparent by describing in further detail embodiments with reference to the accompanying drawings, in which:

FIGS. 7A, 7B, 7C, and 7D are views illustrating an example of a lookup table used in the compensator of FIG. 6;

DETAILED DESCRIPTION

Figure 1:
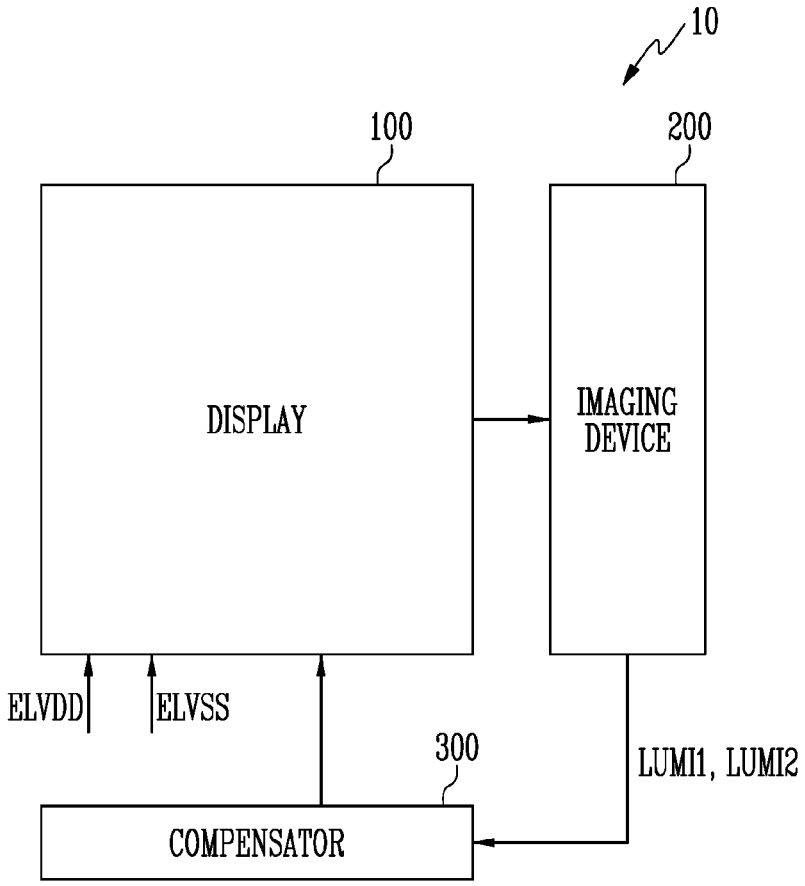
FIG. 1 is a block diagram illustrating an optical compensation system according to embodiments of the present disclosure.

Hereinafter, embodiments of the present disclosure will be described in detail with reference to the accompanying drawings so that those having ordinary knowledge in the technical field to which the present disclosure pertains can easily practice the embodiments. The present disclosure may be embodied in different forms and should not be construed as being limited to the embodiments set forth herein.

Also, in the drawings, portions unrelated to the present disclosure will be omitted in order to clarify the description of the present disclosure, and the same reference numerals refer to like elements throughout. Therefore, the same reference numerals may be used also in other drawings.

FIG. 1 is a block diagram illustrating an optical compensation system according to embodiments of the present disclosure.

Referring to FIG. 1, the optical compensation system 10 may include a display device 100 (or a display, a display panel), an imaging device 200, and a compensator 300.

The display device 100 may include a plurality of pixels, and the pixels may be coupled between a first power source voltage ELVDD (or first power) and a second power source voltage ELVSS (or second power). Here, the first power ELVDD may have a voltage level higher than the voltage level of the second power source voltage ELVSS. The first power ELVDD has a fixed voltage level, and the second power source voltage ELVSS may have a varying voltage level. The specific configuration of the display device 100 will be described later with reference to FIG. 2.

The imaging device 200 may capture an image displayed through the display device 100. For example, the imaging device 200 may include a camera, a scanner, an optical sensor, and the like. The imaging device 200 may measure the luminance of the display device 100 (or the image displayed through the display device 100). The imaging device 200 may divide the display device 100 into a plurality of unit areas, and may measure the luminance of at least one of the unit areas.

When the display device 100 displays an image with the luminance corresponding to a first luminance level, the imaging device 200 may generate a first captured image for the first luminance level or generate first luminance information LUMI1 for the first captured image. Here, the first luminance level is one of a plurality of representative luminance levels used in the optical compensation process of the display device 100, and may be, for example, the luminance level corresponding to the highest luminance, among the 11 representative luminance levels. Also, when the display device 100 displays an image with the luminance corresponding to a second luminance level, the imaging device 200 may generate a second captured image for the second luminance level or generate second luminance information LUMI2 for the second captured image.

The compensator 300 may control the operation of the display device 100 and set or adjust signals required for the operation of the display device 100 based on the images or the pieces of luminance information LUMI1 and LUMI2 (that is, the measured luminance) acquired through the imaging device 200.

For example, the compensator 300 may control the display device 100 in order to display an image in response to the first luminance level (and/or the second luminance level). For example, the compensator 300 may supply signals corresponding to the first luminance level (e.g., the second power source voltage ELVSS) to the display device 100.

The compensator 300 may set or adjust the first voltage level of the second power source voltage ELVSS of the display device 100 for the first luminance level based on the first luminance level and the first luminance information LUMI1. Also, the compensator 300 may set or adjust the second voltage level of the second power source voltage ELVSS of the display device 100 for the second luminance level based on the second luminance level and the second luminance information LUMI2.

In an embodiment, the compensator 300 may set third voltage levels (or first voltage levels) of the second power source voltage ELVSS for the representative luminance levels including the first luminance level and the second luminance level (e.g., the 11 voltage levels for the 11 representative luminance levels) based on the first voltage level and the second voltage level.

In an embodiment, based on the third voltage levels and the offsets according to the driving conditions of the display device 100, the compensator 300 may set fourth voltage levels (or second voltage levels) of the second power source voltage ELVSS for the respective driving conditions. For example, the compensator 300 may receive a reference offset lookup table (that is, a lookup table (hereinafter, referred to as an "LUT") including reference luminance/temperature offsets for the voltage levels of the second power source voltage ELVSS) from the outside, extract temperature offsets from the reference offset LUT, and set the fourth voltage levels of the second power source voltage ELVSS under respective temperature conditions (e.g., a total of 33 voltage levels at specific three temperatures excluding room temperature) based on the temperature offsets and the third voltage levels.

The reference offset LUT includes a plurality of reference offsets that are preset based on the voltage level of the second power source voltage ELVSS at a specific luminance level. For example, based on the first voltage level of the second power source voltage ELVSS at the first luminance level (e.g., the luminance level corresponding to the maximum luminance), the reference offset LUT may include the preset reference offsets for the other voltage levels of the second power source voltage ELVSS. However, because the reference offsets are applied in common to all of display devices, the reference offsets are set in order to include a margin for covering the variation in all of the display devices. Accordingly, the voltage levels of the second power source voltage ELVSS set based on the reference offsets (e.g., the reference voltage levels) may not be optimized for the display device 100.

Accordingly, the optical compensation system 10 according to embodiments of the present disclosure may set the second voltage level of the second power source voltage ELVSS for the second luminance level in addition to the first voltage level of the second power source voltage ELVSS for the first luminance level, and may set the voltage levels of the second power source voltage ELVSS optimized for the display device 100 based on the first voltage level and the second voltage level.

The compensator 300 generates or changes a power LUT based on the third voltage levels and the fourth voltage levels, and the power LUT may be recorded in the display device 100 (e.g., a memory device or a driver integrated circuit in the display device 100) or updated during the optical compensation process.

Also, the compensator 300 may set or adjust the gamma voltages of the display device 100. Here, the gamma voltages may be the voltages used in order to generate data voltages supplied to the pixels in the display device 100. For example, after the power LUT is recorded in the display device 100, reference gamma voltages corresponding to specific grayscale values are set through a multi-time programming method, and the gamma voltages corresponding to all of the grayscale values may be set by dividing the reference gamma voltages.

The compensator 300 may generate or convert a gamma LUT including the set gamma voltages, and may record the gamma LUT in the display device 100 (e.g., a memory device or a driver integrated circuit in the display device 100) or update the same.

As described with reference to FIG. 1, the optical compensation system 10 may set the voltage levels of the second power source voltage ELVSS for two luminance levels through actual measurement, and may set the voltage levels of the second power source voltage ELVSS corresponding to all of the luminance levels (or the entire luminance range) based on the measured two voltage levels. Therefore, the display device 100 may be driven with the optimized second power source voltage ELVSS, and the amount of power consumed by the display device 100 may be more reduced.

Meanwhile, although the optical compensation system 10 is described as setting or adjusting the voltage levels of the second power source voltage ELVSS for each driving condition (or the power LUT including the voltage levels) in FIG. 1, the optical compensation system 10 is not limited. For example, the optical compensation system 10 may alternatively set or adjust the voltage levels of the first power source voltage ELVDD when a display device is driven while changing the first power source voltage ELVDD.

Hereinafter, the display device 100 will be described with regard to the second luminance level (or the selection of the second luminance level) used in the optical compensation process, and then the specific configuration of the compensator 300 will be described.

Figure 2:
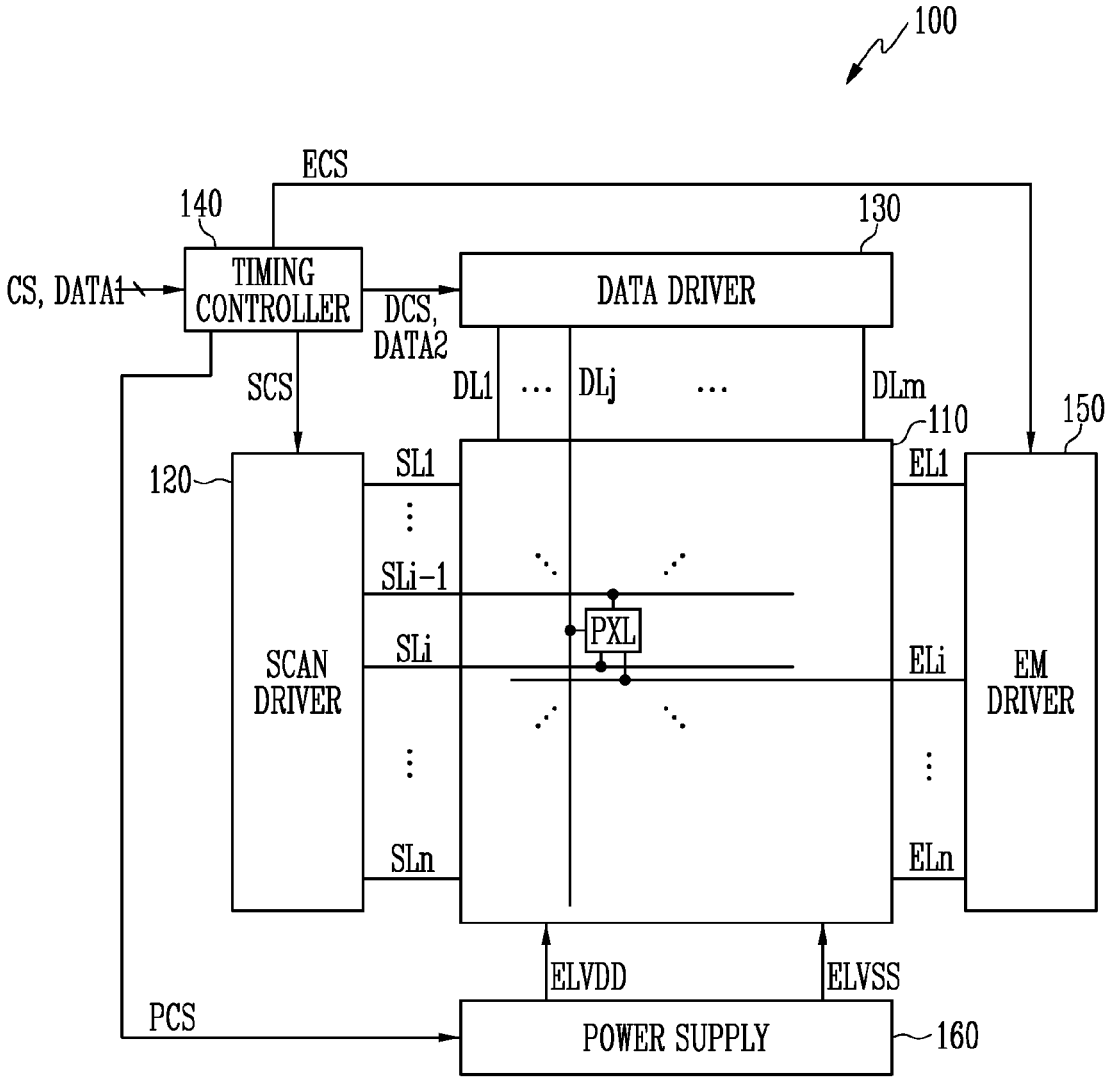
FIG. 2 is a block diagram illustrating an example of a display device included in the optical compensation system of FIG. 1.

FIG. 2 is a block diagram illustrating an example of a display device included in the optical compensation system of FIG. 1.

Referring to FIG. 2, the display device 100 may include a display 110 (or a display panel), a scan driver 120 (or a gate driver), a data driver 130 (or a source driver), a timing controller 140, and an emission driver 150.

The display 110 may include a plurality of scan lines from SL1 to SLn (or gate lines) (n being a positive integer), a plurality of data lines from DL1 to DLm (m being a positive integer), a plurality of emission control lines from EL1 to ELn, and a plurality of pixels PXL. The pixel PXL may be disposed in an area (e.g., a pixel area) divided by the scan lines from SL1 to SLn, the data lines from DL1 to DLm, and the emission control lines from EL1 to ELn.

The pixel PXL may be coupled to at least one of the scan lines from SL1 to SLn, one of the data lines DL1 from to DLm, and at least one of the emission control lines from EL1 to ELn. For example, the pixel PXL may be coupled to the scan line SLi, the previous scan line SLi−1 adjacent to the scan line SLi, the data line DLj, and the emission control line ELi (each of i and j being a positive integer).

The pixel PXL may be initialized in response to a scan signal supplied through the previous scan line SLi−1 (or a scan signal supplied at the previous time, a previous gate signal), may store or record a data signal supplied through the data line DLj in response to a scan signal supplied through the scan line SLi (or a scan signal supplied at the current time, a gate signal), and may emit light with luminance corresponding to the stored data signal in response to an emission control signal supplied through the emission control line ELi.

The scan driver 120 may generate a scan signal based on a scan control signal SCS and sequentially supply the scan signal to the scan lines from SL1 to SLn. Here, the scan control signal SCS includes a scan start signal, scan clock signals, and the like, and may be supplied from the timing controller 140. For example, the scan driver 120 may include a shift register (or a stage) configured to sequentially generate and output a scan signal in the form of a pulse, corresponding to the scan start signal in the form of a pulse, using the scan clock signals. However, the scan signal may have different forms (other than the pulse) based on the form of the scan start signal.

The emission driver 150 may generate an emission control signal based on an emission driving control signal ECS and sequentially supply the emission control signal to the emission control lines from EL1 to ELn. Here, the emission driving control signal ECS includes an emission start signal, emission clock signals, and the like, and may be supplied from the timing controller 140. For example, the emission driver 150 may include a shift register configured to sequentially generate and output an emission control signal in the form of a pulse, corresponding to the emission start signal in the form of a pulse, using the emission clock signals. However, the emission control signal may have different forms (other than the pulse) based on the form of the emission start signal.

In an embodiment, the emission driver 150 may generate an emission control signal having an off-duty that varies depending on a luminance level. Here, the off-duty may be the proportion of a period in which the emission control signal has a turn-off voltage level during one period of the emission control signal. With an increase in the off-duty of the emission control signal, the luminance of a pixel may decrease. Therefore, the display device 100 may change luminance by adjusting the off-duty in a specific luminance range (e.g., a low luminance range). That is, the emission driver 150 (and the display device 100) may operate using an impulsive dimming driving method.

The data driver 130 may generate data signals based on image data DATA2 and a data control signal DCS supplied from the timing controller 140 and supply the data signals to the display 110 (or the pixel PXL). Here, the data control signal DCS is a signal for controlling the operation of the data driver 130, and may include a load signal (or a data enable signal) for dictating the output of an effective data signal, and the like.

The timing controller 140 may receive an input image data DATA1 and a control signal CS from the outside (e.g., a graphics processor), generate a scan control signal SCS and a data control signal DCS based on the control signal CS, and generate image data DATA2 by converting the input image data DATA1. For example, the timing controller 140 may convert the input image data DATA1 in an RGB format into the image data DATA2 in an RGBG format corresponding to the pixel array in the display 110.

Also, the timing controller 140 may generate a power control signal PCS. For example, the timing controller 140 may determine the luminance level of the display device 100 based on the input image data DATA1 and generate a power control signal PCS corresponding to the luminance level.

A power supply 160 may generate first and second power source voltages ELVDD and ELVSS and supply the same to the display 110. As described with reference to FIG. 1, the power source voltages ELVDD and ELVSS are voltages required for the operation of the pixel PXL. The first power source voltage ELVDD has a voltage level higher than the voltage level of the second power source voltage ELVSS, and the first power source voltage ELVDD may have a fixed voltage level.

In an embodiment, the power supply 160 may change the second power source voltage ELVSS based on the power control signal PCS. For example, as the luminance level corresponding to the power control signal PCS is lower (that is, as the luminance is lower), the voltage level of the second power source voltage ELVSS may be higher or the magnitude of the second power source voltage ELVSS may be smaller.

Meanwhile, at least one of the scan driver 120, the data driver 130, the timing controller 140, the emission driver 150, and the power supply 160 may be formed in the display 110, or may be implemented as an IC and coupled to the display 110 through a flexible circuit board. For example, the data driver 130, the timing controller 140, and the emission driver 150 may be implemented as a single IC (e.g., a driver integrated circuit). Also, at least two of the scan driver 120, the data driver 130, the timing controller 140, and the emission driver 150 may be implemented as a single IC.

Figure 3:
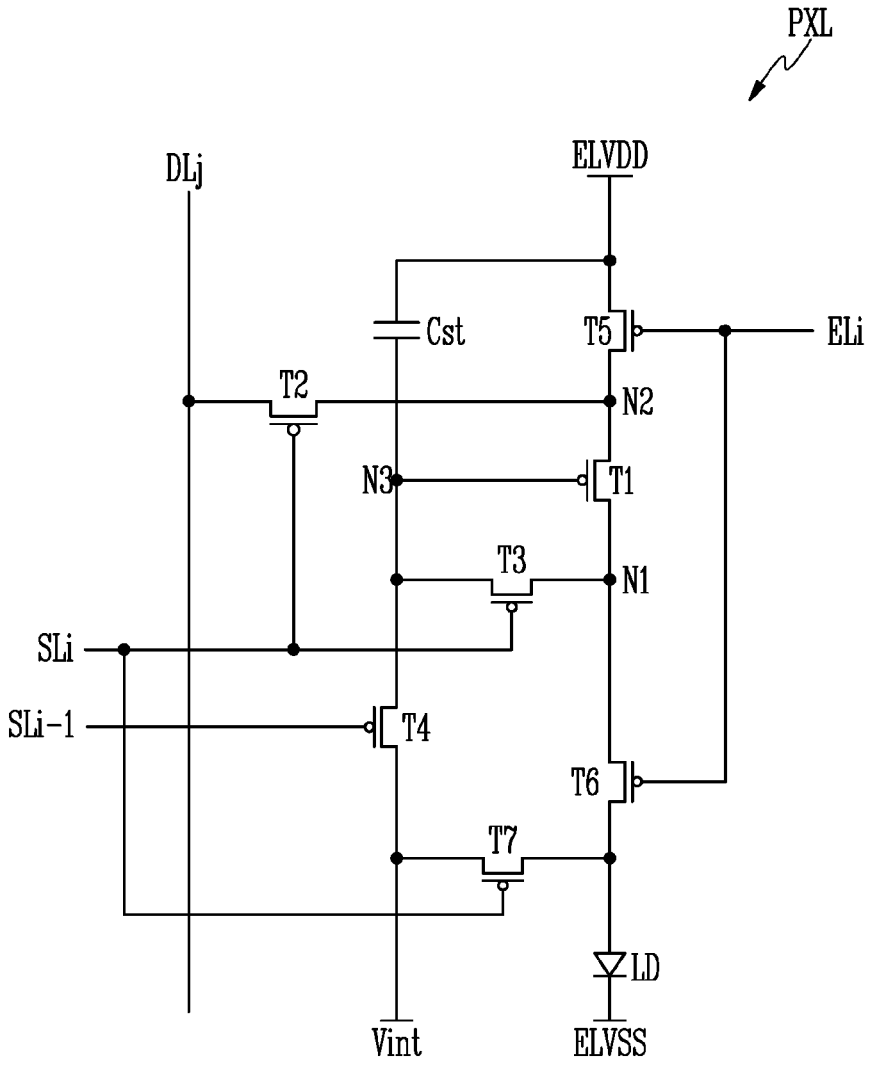
FIG. 3 is a circuit diagram illustrating an example of a pixel included in the display device of FIG. 2.
Figure 4:
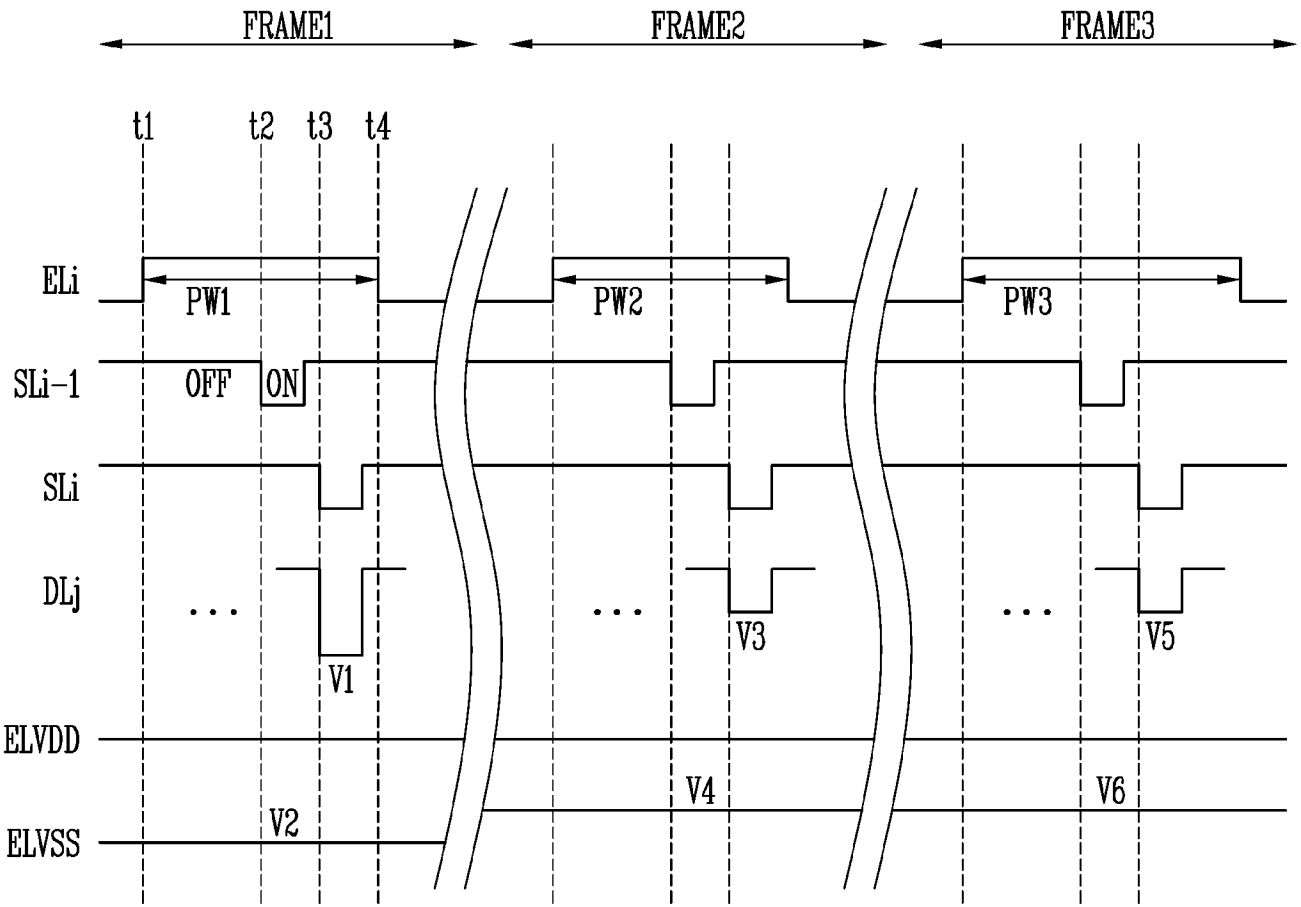
FIG. 4 is a waveform diagram for explaining the operation of the pixel of FIG. 2.
Figure 5:
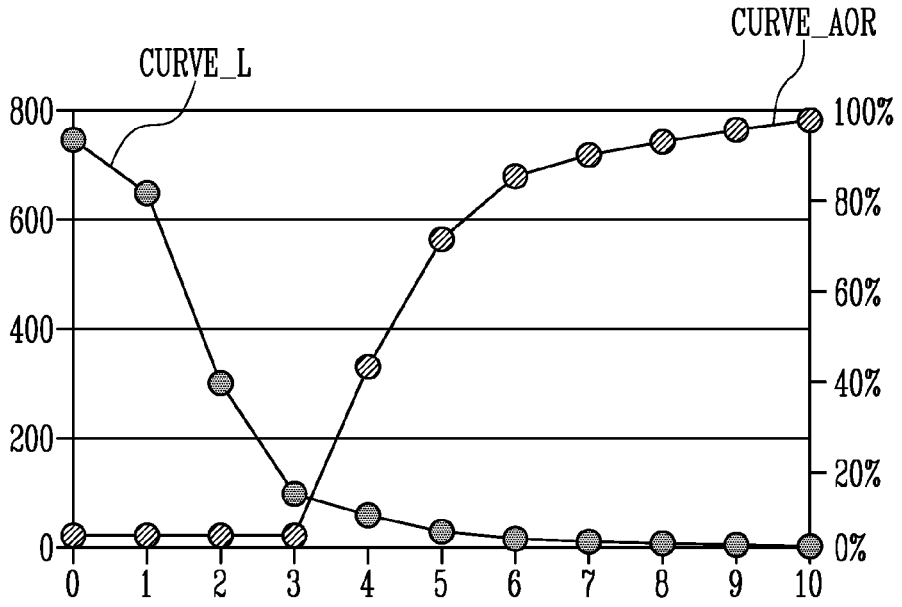
FIG. 5 is a view illustrating an off-duty depending on the luminance level of an emission control signal.

FIG. 3 is a circuit diagram illustrating an example of a pixel included in the display device of FIG. 2. FIG. 4 is a waveform diagram for explaining the operation of the pixel of FIG. 2. FIG. 5 is a view illustrating an off-duty depending on the luminance level of an emission control signal.

Referring to FIG. 3, a pixel PXL may include first, second, third, fourth, fifth, sixth, and seventh transistors (T1, T2, T3, T4, T5, T6, and T7), a storage capacitor Cst, and a light-emitting element LD.

Each of the first to seventh transistors (T1, T2, T3, T4, T5, T6, and T7) may be implemented as a P-type transistor, but is not limited. For example, at least some of the first to seventh transistors (T1, T2, T3, T4, T5, T6, and T7) may be implemented as N-type transistors.

A first electrode of the first transistor T1 (driving transistor) may be coupled to a second node N2 or a first power line via the fifth transistor T5. A second electrode of the first transistor T1 may be coupled to a first node N1 or An anode of the light-emitting element LD via the sixth transistor T6. A gate electrode of the first transistor T1 may be coupled to a third node N3. The first transistor T1 may control the amount of current flowing from a first power line (that is, the power line for transmitting a first power source voltage ELVDD) to a second power line (that is, the power line for transmitting a second power source voltage ELVSS) via the light-emitting element LD in response to the voltage of the third node N3.

The second transistor T2 may be coupled between a data line DLj and the second node N2. The gate electrode of the second transistor T2 may be coupled to a scan line SLi. When a scan signal is supplied to the scan line SLi, the second transistor T2 is turned on so that it electrically connects the data line DLj to the first electrode of the first transistor T1.

The third transistor T3 may be coupled between the first node N1 and the third node N3. The gate electrode of the third transistor T3 may be coupled to the scan line SLi. When a scan signal is supplied to the scan line SLi, the third transistor T3 is turned on so that it electrically connects the first node N1 to the third node N3. Accordingly, when the third transistor T3 is turned on, the first transistor T1 may be coupled in the form of a diode.

The storage capacitor Cst may be coupled between the first power line and the third node N3. The storage capacitor Cst may store a voltage corresponding to a data signal and the threshold voltage of the first transistor T1.

The fourth transistor T4 may be coupled between the third node N3 and an initialization power line (that is, the power line for transmitting an initialization power voltage Vint). The gate electrode of the fourth transistor T4 may be coupled to a previous scan line SLi−1. When a scan signal is supplied to the previous scan line SLi−1, the fourth transistor T4 is turned on so that it supplies the initialization power voltage Vint to the third node N3. Here, the initialization power voltage Vint may be set in order to have a lower voltage level than the data signal.

The fifth transistor T5 may be coupled between the first power line and the second node N2. The gate electrode of the fifth transistor T5 may be coupled to an emission control line ELi. When an emission control signal is supplied to the emission control line ELi, the fifth transistor T5 may be turned off. Otherwise, the fifth transistor T5 may be turned on.

The sixth transistor T6 may be coupled between the first node N1 and the light-emitting element LD. The gate electrode of the sixth transistor T6 may be coupled to the emission control line ELi. When an emission control signal is supplied to the emission control line ELi, the sixth transistor T6 may be turned off. Otherwise, the sixth transistor T6 may be turned on.

The seventh transistor T7 may be coupled between the initialization power line and the anode of the light-emitting element LD. The gate electrode of the seventh transistor T7 may be coupled to the scan line SLi. When a scan signal is supplied to the scan line SLi, the seventh transistor T7 is turned on so that it supplies the initialization power voltage Vint to the anode of the light-emitting element LD.

The anode of the light-emitting element LD may be coupled to the first transistor T1 via the sixth transistor T6, and the cathode of the light-emitting element LD may be coupled to the second power line. The light-emitting element LD may generate light with predetermined luminance in response to the current supplied from the first transistor T1. In order to flow current to the light-emitting element LD, the first power source voltage ELVDD may be set in order to have a higher voltage level than the second power source voltage ELVSS.

Referring to FIG. 3 and FIG. 4, the pixel PXL emits light with high luminance (or middle luminance) in a first frame FRAME1 and a second frame FRAME2 and to emit light with low luminance in a third frame FRAME3. Here, the high luminance (or the middle luminance) falls within a range from about 100 nits to about 750 nits in the luminance values illustrated in FIG. 5, and the low luminance may be equal to or less than about 100 nits, among the luminance values illustrated in FIG. 5.

As depicted in FIG. 4, at the first time point t1 in the first frame FRAME1, the emission control signal applied to the emission control line ELi may change from a turn-on voltage level (or a low logic level) to a turn-off voltage level (or a high logic level). In this case, the fifth and sixth transistors T5 and T6 (or emission transistors) are turned off, and the light-emitting element LD may not emit light.

Then, at the second time point t2, the scan signal applied to the previous scan line SLi−1 may change from the turn-off voltage level to the turn-on voltage level. In this case, the fourth transistor T4 may be turned on, and the third node N3 (or the gate electrode of the first transistor T1, the storage capacitor Cst) may be initialized by the initialization power voltage Vint.

Then, at the third time point t3, the scan signal applied to the scan line SLi may change from the turn-off voltage level to the turn-on voltage level. Meanwhile, the scan signal applied to the previous scan line SLi−1 may change from the turn-on voltage level to a turn-off voltage level. In this case, the fourth transistor T4 may be turned off, the second transistor T2 and the third transistor T3 may be turned on, and the data voltage of the data line DLj may be transmitted to the second node N2. For example, when the data voltage corresponds to high luminance (or a high gray scale), the data voltage may have a first level V1.

Also, the seventh transistor T7 may be turned on, and the anode electrode of the light-emitting element LD (or the light-emitting element LD) may be initialized.

Then, at the fourth time point t4, the emission control signal applied to the emission control line ELi may change from the turn-off voltage level to the turn-on voltage level. In this case, the fifth and sixth transistors T5 and T6 (or emission transistors) may be turned on, and the light-emitting element LD may emit light with luminance corresponding to the data voltage of the first level V1.

In the first frame FRAME1, the second power source voltage ELVSS has a second level V2, and the second level V2 may be lower than the first level V1. According to the circuit structure of the pixel PXL described with reference to FIG. 3, the second power source voltage ELVSS may be set lower than the data voltage.

The operation of the pixel PXL in the second frame FRAME2 may be the same as or similar to the operation of the pixel PXL in the first frame FRAME1. When the data voltage corresponds to a middle luminance (e.g., the luminance of 100 nits), the data voltage may have the third level V3. When the second frame FRAME2 is compared with the first frame FRAME1, only the voltage level of the data voltage may be changed in the second frame FRAME2. For example, the data voltage has a third level V3 in the second frame FRAME2, and the third level V3 may be higher than the first level V1, or the voltage magnitude of the third level V3 may be smaller than the voltage magnitude of the first level V1. Because the second power source voltage ELVSS only needs to be lower than the data voltage, the second power source voltage ELVSS may have a fourth level V4 higher than the second level V2.

The width of a second period PW2 (or the off-duty) in which the emission control signal has the high logic level (or the turn-off voltage level) in the second frame FRAME2 may be equal to the width of a first period PW1 in which the emission control signal has the high logic level (or the turn-off voltage level) in the first frame FRAME1.

That is, the pixel PXL may be driven using a gamma dimming method configured to change a data voltage in a high luminance (and a middle luminance) range.

Meanwhile, the operation of the pixel PXL in the third frame FRAME3 may be similar to the operation of the pixel PXL in the second frame FRAME2. The data voltage has a fifth level V5, and the fifth level V5 may be equal to the third level V3. Accordingly, the second power source voltage ELVSS may have a sixth level V6 that is equal or similar to the fourth level V4. However, the width of a third period PW3 in which the emission control signal has the high logic level (or a turn-off voltage level) in the third frame FRAME3 is different from the width of the second period PW2 in which the emission control signal has the high logic level (or a turn-off voltage level) in the second frame FRAME2, and for example, the width of the third period PW3 may be greater than the width of the second period PW2.

That is, in a low luminance range, the pixel PXL may be driven using an emission dimming driving method configured to change an emission time (or the off-duty of an emission signal) in the state in which the data voltage is maintained constant.

Referring to FIG. 5, a first curve CURVE_L (or a luminance curve) illustrates the luminance of the display device 100 depending on a luminance level, and a second curve CURVE_AOR (or an off-duty curve) illustrates the off-duty of the display device 100 (or the pixel PXL) depending on the luminance level.

For example, a reference luminance level (that is, the luminance level of 0) corresponds to the luminance of 750 nits, in which case the off-duty may be about 2.9% (that is, the width of the first period PW1 illustrated in FIG. 4 may be about 2.9% of that of the first frame FRAME1).

The first, second, third, fourth, fifth, sixth, seventh, eighth, ninth, and tenth luminance levels may correspond to luminance of about 650 nits, about 300 nits, about 100 nits, about 60 nits, about 30 nits, about 15 nits, about 10 nits, about 7 nits, about 4 nits, and about 2 nits, respectively. However, since these are only examples, the luminance corresponding to each luminance level may be variously set.

At the first, second, and third luminance levels, the off-duty may be about 2.9%. At the luminance level lower than the third luminance level (e.g., the luminance of 100 nits), the off-duty may increase. For example, at fourth, fifth, sixth, seventh, eighth, ninth, and tenth luminance levels, the off-duty may be about 41.8%, 70.9%, 85.4%, 90.3%, 93.2%, 96.1%, and 98.1% respectively.

Here, the fourth luminance level (that is, the luminance level at which the off-duty starts to change) may be selected as the second luminance level described with reference to FIG. 1 (that is, the luminance level for setting the second voltage level of the second power source voltage ELVSS). Meanwhile, the reference luminance level (that is, the luminance level corresponding to the maximum luminance of the display device 100) may be the first luminance level described with reference to FIG. 1 (that is, the luminance level for setting the first voltage level of the second power source voltage ELVSS). That is, the voltage levels of the second power source voltage ELVSS may be set at the luminance levels at which the data voltage actually has the maximum voltage level and the minimum voltage level. Accordingly, the voltage levels of the second power source voltage ELVSS that are more optimized for the display device 100 may be set, and the amount of power consumed by the display device 100 may be more reduced.

However, the second luminance level (that is, the luminance level for setting the second voltage level of the second power source voltage ELVSS) is not limited to the above example, and for example, the second luminance level may be the first luminance level illustrated in FIG. 5 (that is, the luminance level corresponding to about 600 nits). This will be described later with reference to FIG. 7D.

Figure 6:
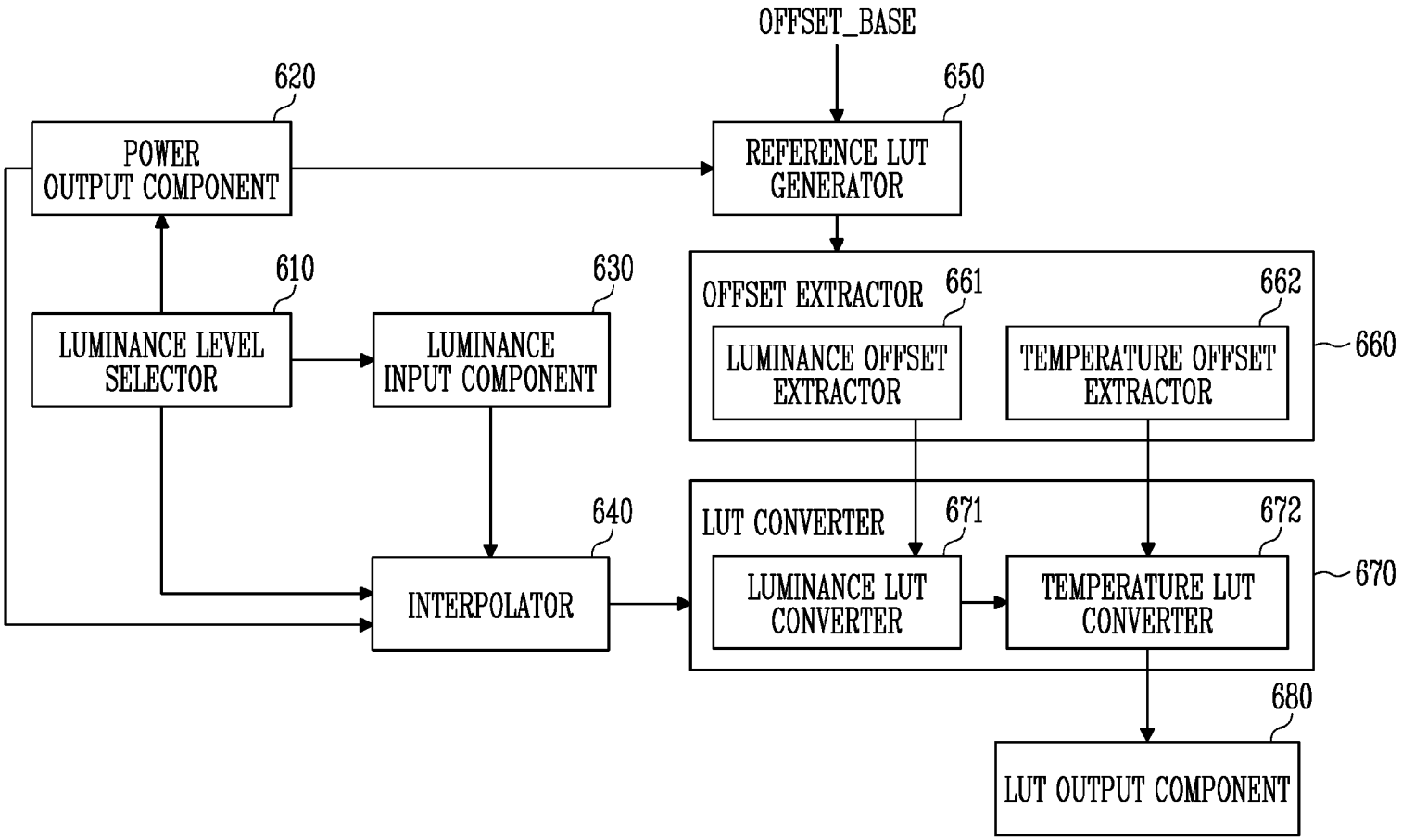
FIG. 6 is a block diagram illustrating an example of a compensator included in the optical compensation system of FIG. 1.

FIG. 6 is a block diagram illustrating an example of the compensator included in the optical compensation system of FIG. 1. FIGS. 7A, 7B, 7C, and 7D are views illustrating an example of a lookup table used in the compensator of FIG. 6. A first LUT LUT1 including reference offsets is illustrated in FIG. 7A, a second LUT LUT2 including reference voltage levels (or first set voltage levels) of a second power source voltage ELVSS is illustrated in FIG. 7B, a third LUT LUT3 including offsets extracted from the second LUT LUT2 (that is, luminance offsets and temperature offsets) is illustrated in FIG. 7C, and a fourth LUT LUT4 including the voltage levels (or the finally set voltage levels) of the second power source voltage ELVSS is illustrated in FIG. 7D.

Referring to FIG. 1 and FIG. 6, the compensator 300 may include a luminance level selector 610, a power output component 620, a luminance input component 630, an interpolator 640, a reference LUT generator 650, an offset extractor 660, an LUT converter 670, and an LUT output component 680.

The luminance level selector 610 may select two luminance levels for setting the voltage levels of the second power source voltage ELVSS, among various luminance levels.

For example, referring to FIG. 7A, the luminance level selector 610 may select a reference luminance level corresponding to the luminance of about 750 nits and a third luminance level corresponding to the luminance of about 100 nits. Here, the reference luminance level may correspond to the maximum luminance, and the third luminance level may correspond to the luminance at which the method of driving the display device 100 is changed (that is, the luminance at which the off-duty described with reference to FIG. 5 starts to change). In another example, the luminance level selector 610 may select the reference luminance level corresponding to the luminance of about 750 nits and a first luminance level corresponding to the luminance of about 650 nits. Here, the first luminance level may correspond to the luminance having the lowest offset (e.g., the offset of −0.6 V at −20° C.), as illustrated in FIG. 7A.

Hereinafter, the case in which the reference luminance level and the third luminance level are selected is assumed. Also, the reference luminance level is referred to as a first selected luminance level, and the third luminance level is referred to as a second selected luminance level.

The power output component 620 may output a second power source voltage ELVSS having voltage levels corresponding to the selected luminance levels. For example, the second power source voltage ELVSS having a preset first reference voltage level for the first selected luminance level may be output, and the second power source voltage ELVSS having a preset second reference voltage level for the second selected luminance level may be output.

Alternatively, the power output component 620 may output a power control signal that instructs the power supply 160, described with reference to FIG. 2, to output the second power source voltage ELVSS having voltage levels corresponding to the selected luminance levels.

The luminance input component 630 may acquire luminance information (that is, measured luminance) through the imaging device 200 described with reference to FIG. 1.

Meanwhile, the process of adjusting the output of the power output component 620 for the selected luminance levels and the process of measuring luminance through the imaging device 200 are repeated, whereby the voltage levels of the second power source voltage ELVSS for the selected luminance levels may be set. For example, the first voltage level of the second power source voltage ELVSS for the first selected luminance level (e.g., −3.6 V corresponding to about 750 nits and 25° C. in the fourth LUT LUT4) may be set first, and the second voltage level of the second power source voltage ELVSS for the second selected luminance level (e.g., −2 V corresponding to about 100 nits and 25° C. in the fourth LUT LUT4) may be set.

Alternatively, the voltage levels of the second power source voltage ELVSS for the selected luminance levels may be set based on the relationship between the selected luminance levels, the first and second reference voltage levels output from the power output component 620, and the luminance information.

The interpolator 640 may set the voltage levels of the second power source voltage ELVSS for all of the luminance levels based on the first voltage level and the second voltage level of the second power source voltage ELVSS.

For example, the interpolator 640 interpolates between the first voltage level and the second voltage level of the second power source voltage ELVSS so that it sets the voltage level for the first luminance level (e.g., −3.4 V corresponding to about 650 nits and 25° C. in the fourth LUT LUT4) and the voltage level for the second luminance level (e.g., −2.0 V corresponding to about 100 nits and 25° C. in the fourth LUT LUT4). Because the data voltage supplied to the display device (e.g., 100 in FIG. 1) (and the second power source voltage ELVSS which is in proportion to the data voltage) and the luminance have a linear relationship, the interpolator 640 linearly interpolates between the first voltage level and the second voltage level of the second power source voltage ELVSS so that it sets the voltage levels of the second power source voltage ELVSS for high luminance/middle luminance ranges.

The reference LUT generator 650 may set the reference voltage levels of the second power source voltage ELVSS (that is, the second LUT LUT2) based on reference offsets OFFSET_BASE (that is, the first LUT LUT1) provided from the outside and on the first voltage level of the second power source voltage ELVSS, which is set for the first selected luminance level, (that is, the second power source voltage ELVSS that is first set).

Referring to FIG. 7A, the first LUT LUT1 may include reference offsets set based on the reference luminance level at 25° C. (or room temperature). The setting values of the reference offsets are as illustrated in FIG. 7A. Because these are examples, a description of each of the setting values of the reference offsets will be omitted.

The reference LUT generator 650 adds the first voltage level of the second power source voltage ELVSS (that is, the second power source voltage ELVSS that is first set) to each of the reference offsets in the first LUT LUT1 so that it generates or updates the second LUT LUT2.

The second LUT LUT2 may be used in order to acquire the second reference voltage level for the second selected luminance level (e.g., −2.6 V corresponding to about 100 nits in the second LUT LUT2). According to circumstances, the process of generating the second LUT LUT2, that is, the reference LUT generator 650, may be omitted.

The offset extractor 660 may extract luminance offsets and temperature offsets from the second LUT LUT2 (or the first LUT LUT1).

In an embodiment, the offset extractor 660 may include a luminance offset extractor 661 and a temperature offset extractor 662.

The luminance offset extractor 661 may extract luminance offsets for a luminance range, excluding the luminance levels between the first and second selected luminance levels, (e.g., a low luminance range) from the second LUT LUT2 (or the first LUT LUT1).

For example, referring to FIG. 7B and FIG. 7C, the luminance offset extractor 661 may extract luminance offsets for the fourth, fifth, sixth, seventh, eighth, ninth, and tenth luminance levels by subtracting the reference voltage level corresponding to the third luminance level from each of the reference voltage levels corresponding to the fourth, fifth, sixth, seventh, eighth, ninth, and tenth levels at 25° C. in the second LUT LUT2. The extracted luminance offsets may be stored as the luminance offsets at 25° C. in the third LUT LUT3 or used for the update.

Meanwhile, the luminance offsets for the fourth, fifth, sixth, seventh, eighth, ninth, and tenth luminance levels in the third LUT LUT3 are illustrated as being different from each other, but are not limited. As described with reference to FIG. 4 and FIG. 5, because the display device 100 uses the same data voltage at the fourth, fifth, sixth, seventh, eighth, ninth, and tenth luminance levels, the voltage levels of the second power source voltage ELVSS for the fourth, fifth, sixth, seventh, eighth, ninth, and tenth luminance levels are set equal to each other, and all of the luminance offsets for the fourth, fifth, sixth, seventh, eighth, ninth, and tenth luminance levels may be equal to about 0. In this case, the process of extracting the luminance offsets, that is, the luminance offset extractor 661, may be omitted.

Similarly, the temperature offset extractor 662 may extract temperature offsets for temperature conditions, other than room temperature, from the second LUT LUT2 (or the first LUT LUT1).

For example, referring to FIG. 7B and FIG. 7C, the temperature offset extractor 662 may extract temperature offsets for other temperature conditions (that is, 0° C., −10° C. and −20° C.) by subtracting, from each of the reference voltage levels under other temperature conditions (that is, at 0° C., −10° C. and −20° C.) in the second LUT LUT2, the reference voltage level at 25° C. corresponding thereto (that is, the reference voltage level having the same luminance level).

The LUT converter 670 may generate a power LUT based on the voltage levels of the second power source voltage ELVSS set by the interpolator 640 (e.g., the third voltage levels), the luminance offsets, and the temperature offsets. That is, the LUT converter 670 may generate the fourth LUT LUT4 or convert the second LUT LUT2 into the fourth LUT LUT4 based on the third voltage levels and the third LUT LUT3.

In an embodiment, the LUT converter 670 may include a luminance LUT converter 671 and a temperature LUT converter 672.

The luminance LUT converter 671 reflects the third voltage levels of the second power source voltage ELVSS set by the interpolator 640 (that is, the voltage levels of the second power source voltage ELVSS for the reference luminance and the first to third luminance levels) in the fourth LUT LUT4 and adds the voltage level of the second power source voltage ELVSS for the second selected luminance level (that is, the third luminance level) to each of the luminance offsets so that it sets all of the voltage levels of the second power source voltage ELVSS for each luminance value at room temperature (that is, 25° C.).

Similarly, the temperature LUT converter 672 adds the voltage levels set in the luminance LUT converter 671 to the temperature offsets corresponding thereto, thereby setting all of the voltage levels of the second power source voltage ELVSS for each luminance value (e.g., the fourth voltage levels) under other temperature conditions (that is, at 0° C., −10° C., and −20° C.).

Meanwhile, when the luminance offset extractor 661 is omitted, the luminance LUT converter 671 may also be omitted, and the temperature LUT converter 672 may directly receive the voltage levels of the second power source voltage ELVSS set by the interpolator 640 (that is, the third voltage levels).

The LUT output component 680 may provide or record the power LUT (that is, the fourth LUT LUT4) to or in the display device (e.g., 100 in FIG. 2). For example, the fourth LUT LUT4 may be recorded in the timing controller 140, the internal memory device (not shown), and the driver integrated circuit (not shown) in the display device 100.

Meanwhile, the third luminance level corresponding to the luminance of about 100 nits is described as the second selected luminance level in FIGS. 6, 7A, 7B, 7C, and 7D, but is not limited.

In an embodiment, the luminance level selector 610 may select the reference luminance level corresponding to the luminance of about 750 nits and the first luminance level corresponding to the luminance of about 650 nits as the first selected luminance level and the second selected luminance level (or the third selected luminance level) respectively.

Hereinafter, the case in which the reference luminance level and the third luminance level are selected is assumed. Additionally, the reference luminance level is referred to as the first selected luminance level, and the third luminance level is referred to as the third selected luminance level.

As illustrated in FIG. 7A, the first luminance level may have the lowest offset (e.g., an offset of −0.6 V at −20° C.), among all of the luminance levels. That is, the luminance level selector 610 may select the luminance level at which the second power source voltage ELVSS has the lowest voltage level under other temperature conditions as the third selected luminance level. When the first luminance level is selected as the third selected luminance level, the defect of a pixel PXL in the display device (e.g., 100 in FIG. 2) (or an erroneous operation, e.g., a problem in which the pixel PXL emits light with different luminance for the second power source voltage ELVSS that is set low) may be overcome, and the yield of the display device 100 (or the display panel) may be improved, instead of the power-saving efficiency of the display device 100.

The power output component 620 may output the second power source voltage ELVSS having the voltage levels corresponding to the first selected luminance level and the third selected luminance level, the luminance input component 630 may acquire luminance information corresponding to the first selected luminance level and the third selected luminance level, and the first voltage level of the second power source voltage ELVSS for the first selected luminance level and the third voltage level of the second power source voltage ELVSS for the third selected luminance level may be set through a multi-time programming method.

The interpolator 640 may extrapolate from the first voltage level and the third voltage level of the second power source voltage ELVSS, thereby setting the voltage levels of the second power source voltage ELVSS for at least some of the luminance levels.

The operations of the reference LUT generator 650, the offset extractor 660, the LUT converter 670, and the LUT output component 680 based on the third selected luminance level are the same as the operations of the reference LUT generator 650, the offset extractor 660, the LUT converter 670, and the LUT output component 680 based on the second selected luminance level, and thus a repeated description will be omitted.

As described with reference to FIGS. 6, 7A, 7B, 7C, and 7D, the compensator 300 may select two luminance levels, among luminance levels, set the voltage levels of the second power source voltage ELVSS for the selected luminance levels through actual measurement, and set the voltage levels of the second power source voltage ELVSS corresponding to all of the luminance levels (or the entire luminance range) based on the actually measured two voltage levels. Particularly, the first selected luminance level may correspond to the maximum luminance, the second selected luminance level may correspond to the luminance at which the method of driving the display device 100 is changed, and the third selected luminance level may correspond to the luminance at which the second power source voltage ELVSS has the lowest voltage level based on the reference offsets.

Meanwhile, although the compensator 300 is described as selecting two luminance levels, among luminance levels, the compensator 300 may select three luminance levels (that is, the above-described first to third selected luminance levels) so that it sets the voltage levels of the second power source voltage ELVSS (or the power LUT, that is, the fourth LUT LUT4).

Figure 8:
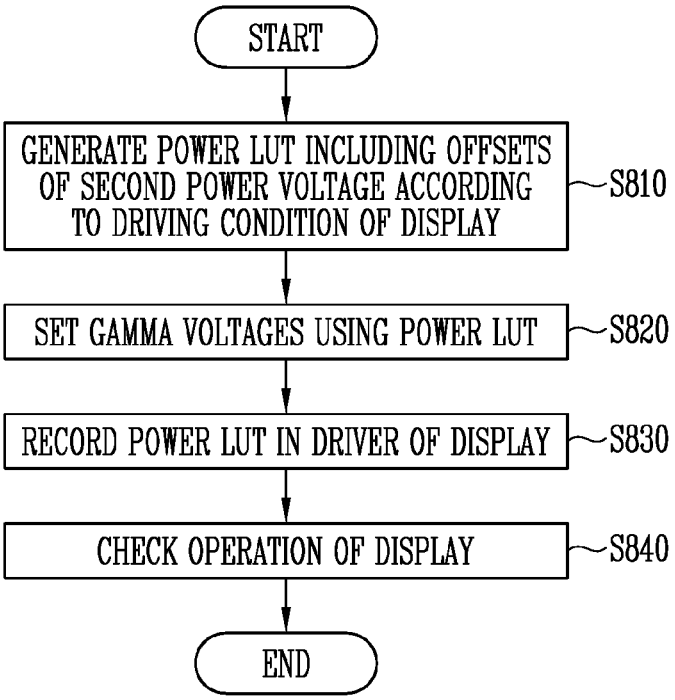
FIG. 8 is a flowchart illustrating an optical compensation method according to embodiments of the present disclosure.

FIG. 8 is a flowchart illustrating an optical compensation method according to embodiments of the present disclosure.

Referring to FIG. 1 and FIG. 8, the method of FIG. 8 may be performed for the display device 100 in the optical compensation system 10 of FIG. 1.

In the method of FIG. 8, an LUT (that is, a power LUT) including the offsets of the second power source voltage ELVSS depending on the driving condition of the display (that is, the display device 100 or the display panel (in FIG. 2)) may be generated at a step S810.

The configuration for generating the power LUT is equal to the operation of the compensator 300 described with reference to FIG. 6, and it will be described later with reference to FIG. 9.

Then, in the method of FIG. 8, at a step S820, the gamma voltages of the display device 100 may be set using the power LUT.

For example, the method of FIG. 8 may be configured such that the second power source voltage ELVSS is supplied to the display device 100 based on the power LUT and the gamma voltages of the display device 100 are set through a multi-time programming method. When the display device 100 is driven in various modes, the method of FIG. 8 may be configured such that the gamma voltages are set for the respective modes. For example, when the display device 100 is driven at a first driving frequency (e.g., 60 Hz) and a second driving frequency (e.g., 75 Hz), the gamma voltages may be set first while the display device 100 is driven at the first driving frequency, and then the gamma voltages may be set while the display device 100 is driven at the second frequency.

In the method of FIG. 8, a gamma LUT including setting values for the gamma voltages of the display device 100 may be generated.

Then, in the method of FIG. 8, the power LUT may be recorded in the display device 100 (or the memory device or the driver integrated circuit in the display device 100) at a step S830. Also, in the method of FIG. 8, the gamma LUT may be recorded in the display device 100.

Then, in the method of FIG. 8, the operation of the display device 100 having the power LUT may be checked at a step S840. In the method of FIG. 8, the operation of the display device 100 may be checked in the same manner as in the step S820 of setting the gamma voltages.

Figure 9:
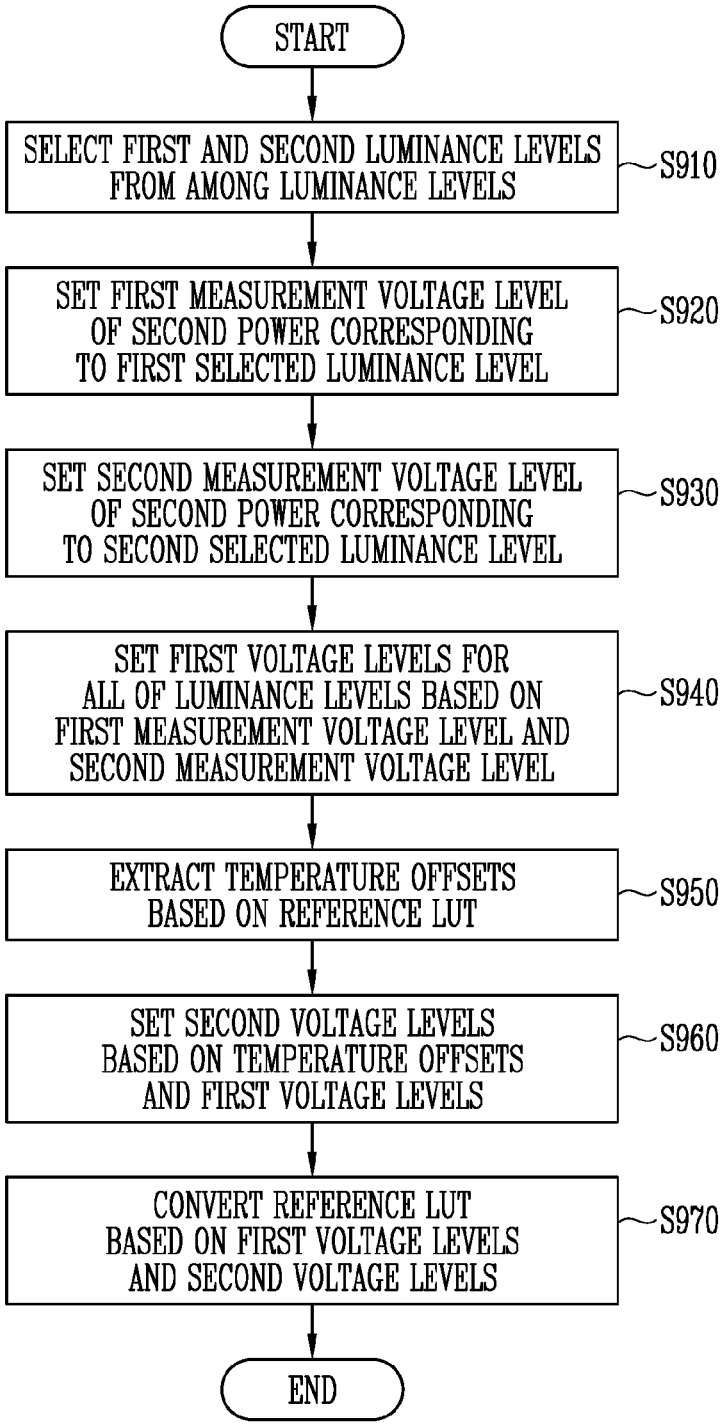
FIG. 9 is a flowchart for explaining a process in which a lookup table is generated through the method of FIG. 8.

FIG. 9 is a flowchart for explaining a process in which an LUT is generated through the method of FIG. 8.

Referring to FIG. 8 and FIG. 9, in the method of FIG. 8, two (or at least two) luminance levels may be selected from among preset luminance levels at a step S910.

As described with reference to FIG. 6, the first selected luminance level may correspond to the maximum luminance of the display device 100 (e.g., the luminance of about 750 nits), and the second selected luminance level may correspond to the luminance at which the method of driving the display device 100 starts to change (e.g., the luminance of about 100 nits). Also, the third selected luminance level may correspond to the luminance having the smallest offset (e.g., the luminance of 650 nits), among the preset reference offsets of the second power source voltage ELVSS described with reference to FIG. 7A (that is, the reference offsets in the first LUT LUT1), or the luminance having the lowest reference voltage level, among the reference voltage levels in the reference LUT (that is, the second LUT (LUT2 in FIG. 7B)).

In the method of FIG. 8, the first voltage level of the second power source voltage ELVSS corresponding to the first selected luminance level may be set at a step S920 while the luminance of the display device 100 is measured.

Then, in the method of FIG. 8, the second voltage level of the second power source voltage ELVSS corresponding to the second selected luminance level may be set at a step S930 while the luminance of the display device 100 is measured.

The configuration for setting the first voltage level and the second voltage level of the second power source voltage ELVSS is the same as or similar to the operations of the luminance level selector 610, the power output component 620, and the luminance input component 630 described with reference to FIG. 6, and thus a repeated description will be omitted.

Then, in the method of FIG. 8, the third voltage levels for all of the luminance levels may be set based on the first voltage level and the second voltage level of the second power source voltage ELVSS at a step S940.

In the method of FIG. 8, the third voltage levels may be set through the interpolator 640, as described with reference to FIG. 6.

Then, in the method of FIG. 8, temperature offsets may be extracted based on the reference LUT at a step S950, and the fourth voltage levels of the second power source voltage ELVSS under temperature conditions, other than room temperature, may be set based on the temperature offsets and the third voltage levels at a step S960.

In the method of FIG. 8, the reference LUT may be generated through the reference LUT generator 650, the temperature offset may be set based on the reference LUT through the offset extractor 660, and the fourth voltage levels of the second power source voltage ELVSS may be set through the LUT converter 670, as described with reference to FIG. 6.

In an embodiment, the luminance offset may be set based on the reference LUT through the offset extractor 660, and the voltage levels at the different luminance levels at room temperature (that is, the remaining voltage levels of the second power source voltage ELVSS at room temperature, excluding the third voltage levels set by the interpolator 640) may be set through the LUT converter 670.

In the method of FIG. 8, the reference LUT may be updated based on the third voltage levels and the fourth voltage levels at a step S970.

In the method of FIG. 8, the power LUT (that is, the fourth LUT LUT4) may be recorded in the display device 100 (or the memory device or the driver integrated circuit in the display device 100), as described with reference to FIG. 6.

An optical compensation system and an optical compensation method of a display device according to the present disclosure may set the voltage levels of a second power source voltage for two luminance levels at room temperature through actual measurement and set the voltage levels of the second power source voltage corresponding to all of the luminance levels (under other temperature conditions) based on the actually measured two voltage levels. Therefore, the display device may be driven with the optimized second power source voltage, whereby the amount of power consumed thereby may be more reduced.

The drawings and the detailed description of the present disclosure are examples for the present disclosure and are provided for illustrative purpose, rather than limiting the scope of the present disclosure described in the claims. Therefore, it will be appreciated to those skilled in the art that various modifications may be made and other embodiments are available. Accordingly, the scope of the present disclosure should be determined by the spirit and scope of the appended claims.

What is claimed is:

1. An optical compensation system, comprising:

a display device including a pixel coupled between a first power line and a second power line;

a compensator configured to supply the second power line of the display device with a second power source; and an imaging device configured to measure a luminance value, wherein the compensator sets voltage levels of the second power source for each luminance and for each temperature based on the luminance value measured by the imaging device and temperature offsets according to temperature conditions under which the display device is driven.

2. The optical compensation system according to claim 1, wherein the compensator:

sets a first voltage level of the second power source corresponding to a first luminance level based on a first luminance value measured by the imaging device, sets a second voltage level of the second power source corresponding to a second luminance level based on a second luminance value measured by the imaging device, and sets third voltage levels of the second power source for representative luminance levels including the first luminance level and the second luminance level based on the first voltage level and the second voltage level.

3. The optical compensation system according to claim 2, wherein:

the pixel includes a light-emitting element, a driving transistor configured to supply a current to the light-emitting element, and an emission transistor coupled between the light-emitting element and the driving transistor and configured to adjust an emission time of the light-emitting element, the first luminance level corresponds to maximum luminance of the display device, the current varies in a luminance range between the first luminance level and the second luminance level, and the current is fixed, but the emission time varies at luminance levels lower than the second luminance level.

4. The optical compensation system according to claim 2, wherein the compensator further sets fourth voltage levels of the second power source for the representative luminance levels according to the temperature conditions based on the temperature offsets and the third voltage levels.

5. The optical compensation system according to claim 4, wherein the compensator comprises:

a luminance level selector configured to select the first luminance level and the second luminance level from among a plurality of luminance levels;

a power output component configured to adjust and output the first voltage level and the second voltage level of the second power source;

an interpolator configured to set the third voltage levels based on the first voltage level and the second voltage level; and a lookup table converter configured to set the fourth voltage levels based on the third voltage levels and the temperature offsets.

6. The optical compensation system according to claim 5, wherein the interpolator sets voltage levels for luminance levels between the first luminance level and the second luminance level by interpolating the first voltage level and the second voltage level.

7. The optical compensation system according to claim 6, wherein the lookup table converter sets voltage levels at luminance levels lower than the second luminance level based on a luminance offset which is preset based on the second voltage level.

8. The optical compensation system according to claim 7, wherein the compensator further comprises:

a reference lookup table generator configured to set reference voltage levels for the second power source according to driving conditions based on the first voltage level and reference offsets according to different driving conditions, which are preset based on the first luminance level; and an offset extractor configured to calculate the luminance offset for the voltage levels for the luminance levels lower than the second luminance level.

9. The optical compensation system according to claim 6, wherein:

the offset extractor extracts the temperature offsets from reference offsets, and the lookup table converter calculates each of the fourth voltage levels by adding each of the third voltage levels and a corresponding temperature offset among the temperature offsets.

10. The optical compensation system according to claim 9, wherein:

the offset extractor calculates the temperature offsets by calculating a difference between a first reference voltage level under a first temperature condition and a second reference voltage level under a second temperature condition among the reference voltage levels, and the first reference voltage level and the second reference voltage level correspond to an identical luminance level.

11. The optical compensation system according to claim 2, wherein:

the first luminance level corresponds to maximum luminance of the display device, and the second luminance level corresponds to luminance having a lowest voltage level or a voltage level of a smallest voltage magnitude, among reference voltage levels derived for driving conditions based on the first voltage level.

12. The optical compensation system according to claim 11, wherein the compensator sets voltage levels for at least some of luminance levels lower than the second luminance level by extrapolating the first voltage level and the second voltage level.

13. An optical compensation method of a display device including a pixel coupled between a first power source and a second power source, comprising steps of:

setting a first voltage level of the second power source corresponding to a first luminance level while measuring luminance of the display device; and setting voltage levels of the second power source for each luminance and for each temperature based on the first voltage level and temperature offsets according to temperature conditions under which the display device is driven.

14. The optical compensation method according to claim 13, further comprising a step of:

setting a second voltage level of the second power source corresponding to a second luminance level while measuring the luminance of the display device, wherein the setting the voltage levels of the second power source is accomplished by setting third voltage levels of the second power source for representative luminance levels including the first luminance level and the second luminance level based on the first voltage level and the second voltage level.

15. The optical compensation method according to claim 14, wherein the setting the voltage levels of the second power source further is accomplished by setting fourth voltage levels of the second power source for the representative luminance levels according to the temperature conditions based on the temperature offsets according to the temperature conditions and on the third voltage levels.

16. The optical compensation method according to claim 15, wherein the setting the third voltage levels comprises a step of:

setting voltage levels for luminance levels between the first luminance level and the second luminance level by interpolating the first voltage level and the second voltage level.

17. The optical compensation method according to claim 16, wherein the setting the third voltage levels further comprises a step of:

setting voltage levels at luminance levels lower than the second luminance level based on a luminance offset which is preset based on the second voltage level.

18. The optical compensation method according to claim 16, wherein the setting the fourth voltage levels comprises steps of:

extracting the temperature offsets from reference offsets according to driving conditions which are preset based on the first luminance level; and adding each of the third voltage levels and a corresponding temperature offset among the temperature offsets.

19. The optical compensation method according to claim 18, wherein the extracting the temperature offsets comprises steps of:

setting reference voltage levels for the second power source for the respective driving conditions based on the first voltage level and the reference offsets according to different driving conditions preset based on the first luminance level; and calculating a difference between a first reference voltage level under a first temperature condition and a second reference voltage level under a second temperature condition among the reference voltage levels, and wherein the first reference voltage level and the second reference voltage level correspond to an identical luminance level.

20. The optical compensation method according to claim 14, wherein:

the first luminance level corresponds to maximum luminance of the display device, and the second luminance level corresponds to luminance having a lowest voltage level or a voltage level of a smallest voltage magnitude among reference voltage levels derived for the respective driving conditions based on the first voltage level.

* * * * *